US008449346B2

(12) United States Patent
Lee

(10) Patent No.: US 8,449,346 B2
(45) Date of Patent: May 28, 2013

(54) BACKWARD MOMENTUM TRANSFERRING MECHANISM FOR TOY GUN

(76) Inventor: Tsung-Ming Lee, Taipei (TW)

( * ) Notice: Subject to any disclaimer, the term of this patent is extended or adjusted under 35 U.S.C. 154(b) by 314 days.

(21) Appl. No.: 12/961,816

(22) Filed: Dec. 7, 2010

(65) Prior Publication Data

US 2012/0138038 A1 Jun. 7, 2012

(51) Int. Cl.
*A63H 5/04* (2006.01)
*F41A 33/06* (2006.01)

(52) U.S. Cl.
CPC . *A63H 5/04* (2013.01); *F41A 33/06* (2013.01)
USPC ..... 446/405; 124/1; 124/80; 446/406; 434/18

(58) Field of Classification Search
CPC ..... A63H 5/04; F41A 33/06
USPC ..... 124/1, 80; 446/405, 406; 434/18
See application file for complete search history.

(56) References Cited

U.S. PATENT DOCUMENTS

| | | | | | |
|---|---|---|---|---|---|
| 2,023,497 | A * | 12/1935 | Trammell | 434/18 |
| 2,356,706 | A * | 8/1944 | Sigg | 446/405 |
| 2,520,281 | A * | 8/1950 | Heide | 434/18 |
| 2,708,319 | A * | 5/1955 | Tratsch | 434/18 |
| 2,989,814 | A * | 6/1961 | Licitis | 42/57 |
| 2,991,781 | A * | 7/1961 | Ayala | 124/71 |
| 3,015,186 | A * | 1/1962 | Cook | 446/406 |
| 3,032,924 | A * | 5/1962 | Carver | 446/406 |
| 3,057,102 | A * | 10/1962 | Hirsch et al. | 42/57 |
| 4,079,525 | A * | 3/1978 | Linton et al. | 434/18 |
| 4,194,304 | A * | 3/1980 | Wolcott | 434/18 |
| 4,380,437 | A * | 4/1983 | Yarborough, Jr. | 434/18 |
| 4,829,877 | A * | 5/1989 | Zerega | 89/14.5 |
| 5,244,431 | A * | 9/1993 | D'Andrade | 446/406 |
| 5,569,085 | A * | 10/1996 | Igarashi et al. | 463/49 |
| 5,653,215 | A * | 8/1997 | Chung et al. | 124/66 |
| 5,857,854 | A * | 1/1999 | Kwalwasser | 434/18 |
| 6,019,681 | A * | 2/2000 | Oishi et al. | 463/49 |
| 6,328,651 | B1 * | 12/2001 | Lebensfeld et al. | 463/52 |
| 6,820,608 | B2 * | 11/2004 | Schavone | 124/74 |
| 6,874,492 | B1 * | 4/2005 | Schavone | 124/31 |
| 7,025,052 | B2 * | 4/2006 | Schavone | 124/74 |
| 7,316,565 | B2 * | 1/2008 | Liao | 434/18 |
| 7,581,954 | B2 * | 9/2009 | Schavone | 434/18 |
| 8,074,392 | B2 * | 12/2011 | Hu | 42/54 |
| 8,123,623 | B2 * | 2/2012 | Kitami et al. | 463/51 |
| 2011/0318715 | A1 * | 12/2011 | Markert et al. | 434/18 |

* cited by examiner

FOREIGN PATENT DOCUMENTS

| | | |
|---|---|---|
| EP | 2177862 A1 | 10/2008 |
| EP | 2113736 A1 | 11/2009 |

OTHER PUBLICATIONS

Communication From European Patent Office in Counterpart European Patent Application 10015468.1; Mail Date May 27, 2011.

*Primary Examiner* — Gene Kim
*Assistant Examiner* — Alexander Niconovich
(74) *Attorney, Agent, or Firm* — Rosenberg, Klein & Lee

(57) ABSTRACT

A toy gun includes a housing; a barrel extending forwardly of the housing; a motor in a pistol grip; a speed reduction gear in the housing and operatively connected to the motor; a bullet loading unit in a forward end of the housing; a spring biased piston in a fixed cylinder of the housing; a trigger for activating the motor for firing; and a backward momentum transferring mechanism partially disposed in a gunstock and including an intermediate weight, a forward sliding rod disposed rearward of the piston, and a rear recoil spring having a front end urging against a rear end of the weight and a rear end urging against an internal wall in the gunstock. The sliding rod is disposed in the housing and spaced apart from the weight. The backward momentum transferring mechanism can simulate recoil by generating a recoil shock.

4 Claims, 6 Drawing Sheets

BACKWARD MOMENTUM TRANSFERRING MECHANISM FOR TOY GUN

FIELD OF THE INVENTION

The invention relates to toy guns and more particularly to a backward momentum transferring mechanism for a toy gun for simulating recoil by generating a recoil shock.

BACKGROUND OF THE INVENTION

Toy guns (or so-called BB guns) are very popular nowadays. A typical toy gun comprises a trigger, a bullet loading device with bullets (e.g., plastic pellets) in a ready to shoot position, and a firing mechanism. A shooter may press back the trigger to activate the firing mechanism to eject the bullet out of a barrel.

However, one drawback of the typical toy gun is that there is no generation of recoil. Thus, a shooter may be not satisfied with it.

Therefore, there is a need for a device which can simulate recoil by driving a spring biased weight in a gunstock backward to transfer momentum from projectiles that leave the barrel when the toy gun is discharged.

In a known prior art toy gun, there is provided with a backward momentum transferring mechanism for simulating recoil. The conventional backward momentum transferring mechanism mainly includes a housing, a speed reduction gear, a trigger, a forward bullet loading unit, a piston, and a piston spring. The speed reduction gear is operatively connected to a motor in a pistol grip. The piston is moveably disposed in a fixed cylinder, and piston is biased the piston spring. The trigger is exposed and can be used to activate the motor for firing when it is pressed backed by the finger. A barrel extends forwardly of the housing. A connection rod is firmly connected between the piston and a weight which is arranged in a gunstock of the housing.

It is noted that the conventional structure of the backward momentum transferring mechanism exists a number of disadvantages. For example, because the connection rod between the piston and the weight is firmly connected, the speed reduction gear and the piston are often damaged when the weight and the piston are not in cooperation in reciprocal motion. Also, the conventional backward momentum transferring mechanism can not generate clear metal sound.

Further, the conventional backward momentum transferring mechanism is provided with a stop plate in the housing in order to stop the weight each time the weight is in a forward movement. As result, the components of the top gun are often damaged. In addition, the stop plate limits the travel stroke of the weight.

SUMMARY OF THE INVENTION

It is therefore one object of the invention to provide a toy gun comprising a housing; a barrel extending forwardly of the housing; a motor in a pistol grip; a speed reduction gear in the housing and operatively connected to the motor; a bullet loading unit in a forward end of the housing; a spring biased piston in a fixed cylinder of the housing; a trigger for activating the motor for firing; and a backward momentum transferring mechanism partially disposed in a gunstock and including an intermediate weight, a forward sliding rod disposed rearward of the piston, and a rear recoil spring having a front end urging against a rear end of the weight and a rear end urging against an internal wall in the gunstock, wherein the sliding rod is disposed in the housing and spaced apart from the weight.

The above and other objects, features and advantages of the invention will become apparent from the following detailed description taken with the accompanying drawings.

DETAILED DESCRIPTION OF THE INVENTION

Figure 1:
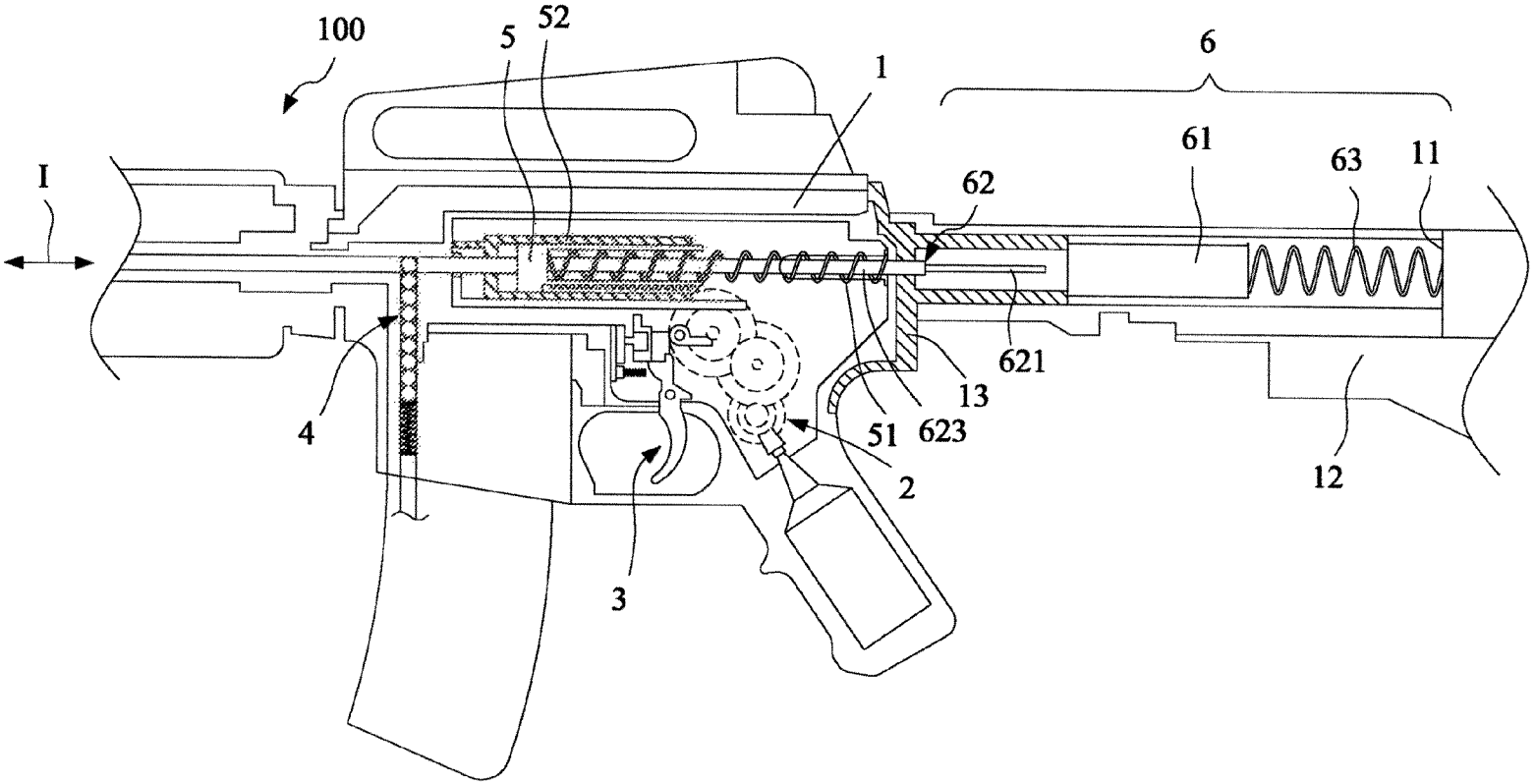
FIG. 1 is a longitudinal sectional view of a main portion of a rifle-type toy gun according to the invention with a piston spring in an expanded state and incorporating a first preferred embodiment of backward momentum transferring mechanism.
Figure 2:
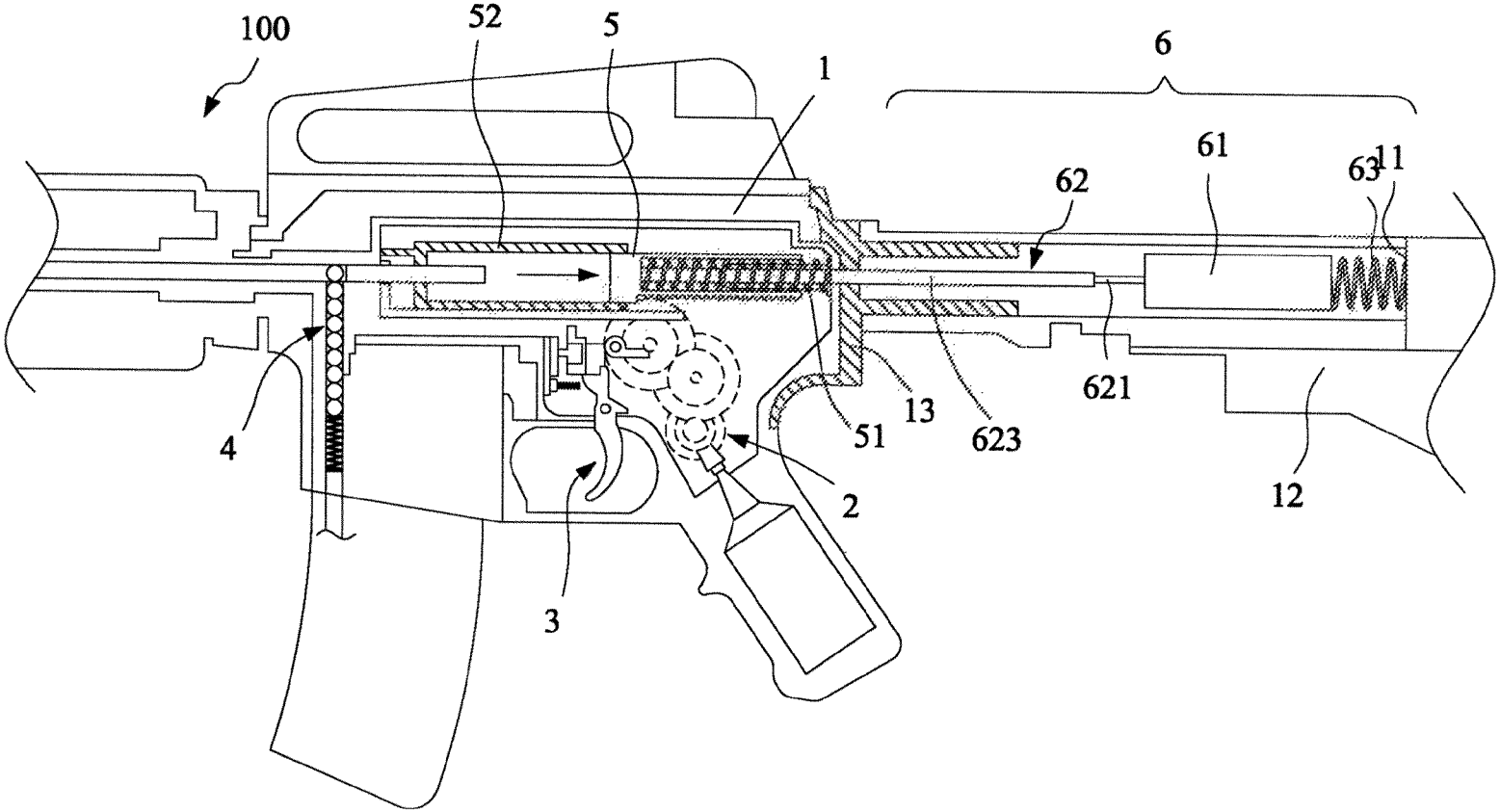
FIG. 2 is a view similar to FIG. 1 with the piston spring compressed and the piston moved back as a result of the firing.
Figure 3:
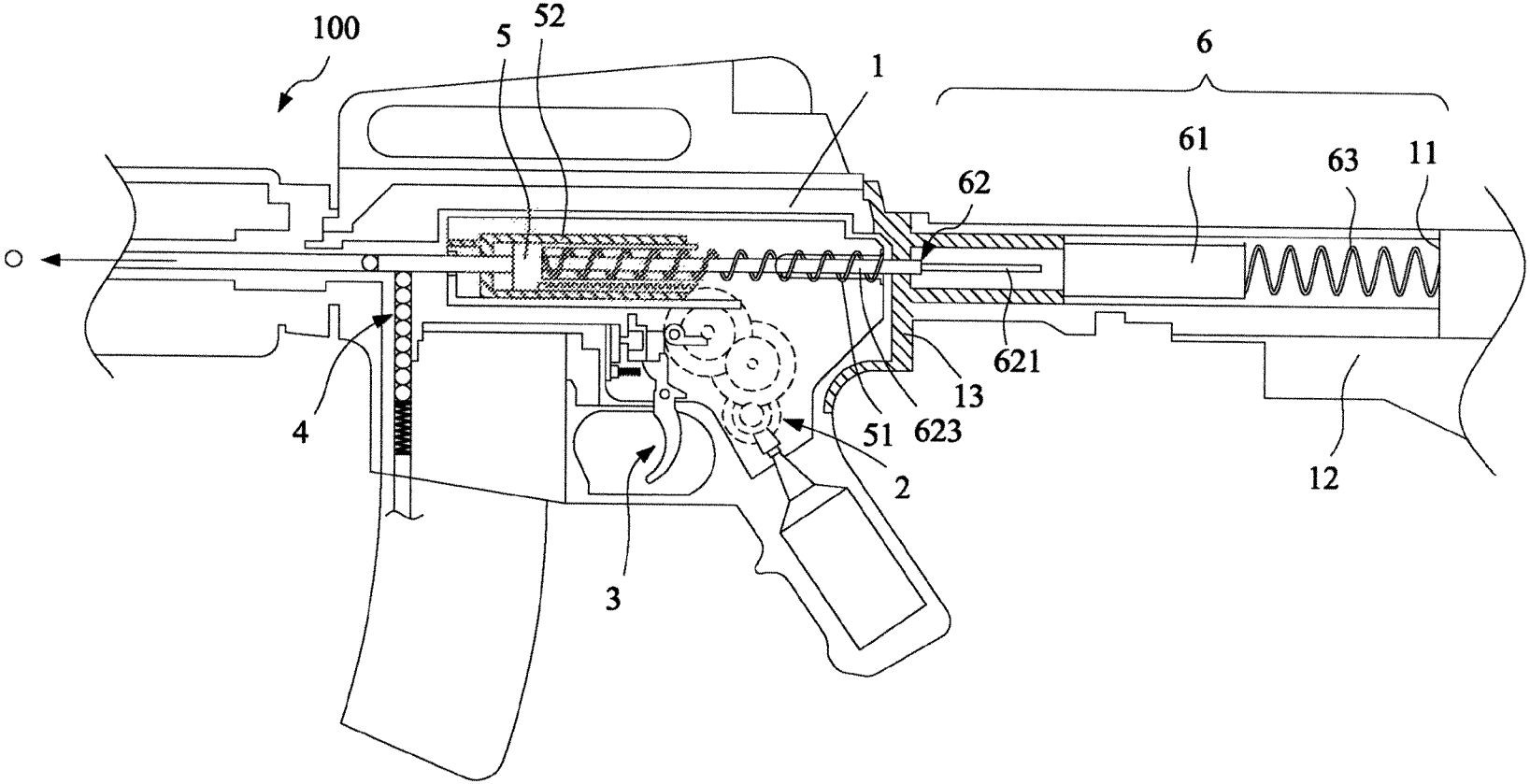
FIG. 3 is a view similar to FIG. 1 with a bullet leaving the barrel after firing.
Figure 4:
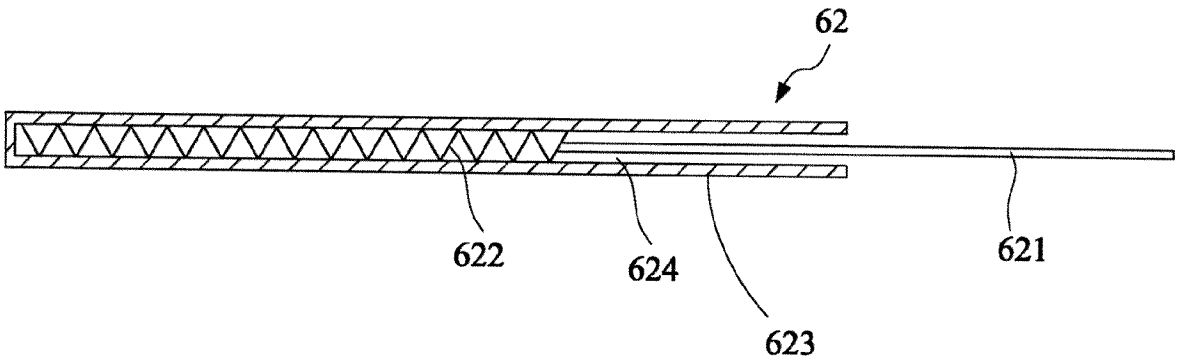
FIG. 4 is a longitudinal sectional view of the spring biased rod.

Referring to FIGS. 1 to 4, a rifle-type toy gun 100 according to the present invention incorporating a first preferred embodiment of backward momentum transferring mechanism 6 is shown.

The toy gun 100 in accordance with a first embodiment of the present invention comprises a housing 1, a speed reduction gear 2, a trigger 3, a forward bullet loading unit 4, a piston 5, and a piston spring 51. The speed reduction gear 2, the trigger 3, the forward bullet loading unit 4, the piston 5, and the piston spring 51 are accommodated in the housing 1. The speed reduction gear 2 is operatively connected to a motor in an inclined pistol grip. The piston 5 is moveably disposed in a fixed cylinder 52, and piston 5 is biased the piston spring 51. The trigger 3 is exposed and can be used to activate the motor for firing when it is pressed backed by the finger. A barrel extends forwardly of the housing 1.

The backward momentum transferring mechanism 6 is partially disposed in a gunstock 12 and disposed rearward of the piston 5 (i.e., the housing 1). Thus, the backward momentum transferring mechanism 6 and the piston 5 can co-act in a reciprocal fashion along a moving direction I of the piston 5. The backward momentum transferring mechanism 6 comprises an intermediate weight 61, a spring biased rod 62 disposed rearward of the piston 5, and a rear recoil spring 63 having a front end urging against a rear end of the weight 61 and a rear end urging against a stop wall 11 in the gunstock 12. A rear end of the spring biased rod 62 extends into a space formed in the gunstock 12 via a through hole formed on an internal wall 13 of the housing 1. The spring biased rod 62 acts a sliding rod in this embodiment.

That is, in the first embodiment of the present invention, the backward momentum transferring mechanism 6 is disposed between the piston 5 and the intermediate weight 61. A front end of the spring biased rod 62 engages with the piston 5, and a rear end of the spring biased rod 62 extends into the gunstock 12. The spring biased rod 62 is spaced apart from the weight 61 and is slidably disposed in the housing 1. The spring biased rod 62 comprises a receptacle 623, a helical spring 622 disposed in a hollow space 624 formed in the receptacle 623, and an elongated rod 621 partially disposed in the hollow space 624 of the receptacle 623 and having a front end engaged with a rear end of the spring 622. Thus, the rod 621 can slide relative to the receptacle 623 as a result of the compression or expansion of the spring 622.

A shooter may press back the trigger 3 to activate the motor to eject a bullet (e.g., plastic pellet) out of the barrel. And in turn, the piston 5 is pushed back to move the rod 621 of the backward momentum transferring mechanism 6 rearward. The rod 621 further contacts the weight 61 and pushes same rearward. Thus, the recoil spring 63 is compressed by the weight 61. This action can simulate recoil.

Figure 5:
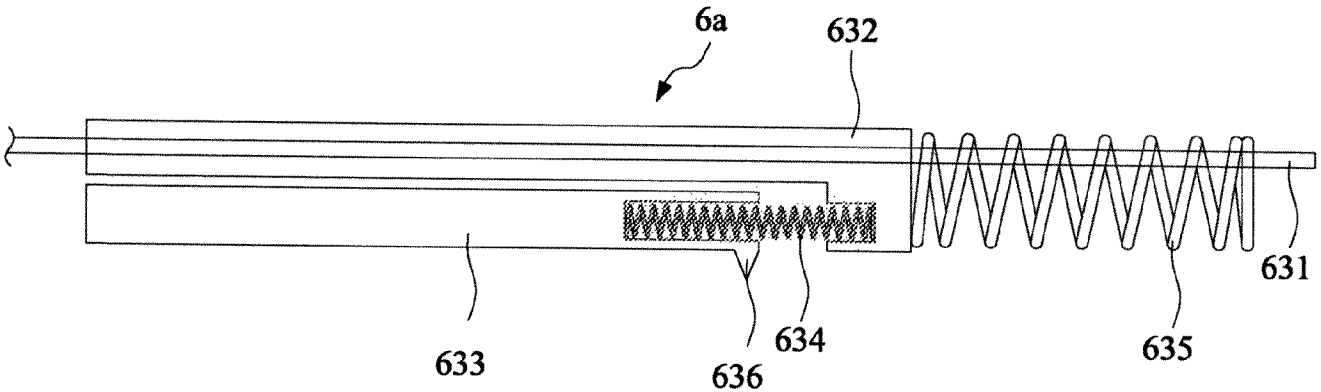
FIG. 5 is a longitudinal sectional view of the backward momentum transferring mechanism in accordance with a second embodiment of the present invention.

Referring to FIG. 5, a second preferred embodiment of backward momentum transferring mechanism 6*a* in accordance with the invention is shown. In this embodiment, the backward momentum transferring mechanism 6*a* comprises a first weight 632, a second weight 633, a balance spring 634 interconnecting the first weight 632 and the second weight 633, a detent 636 on the underside of the second weight 633, an elongated rod 631 through the first weight 632, and a torsion spring 635 put on the rod 631 and biasing against the first weight 632.

Figure 6:
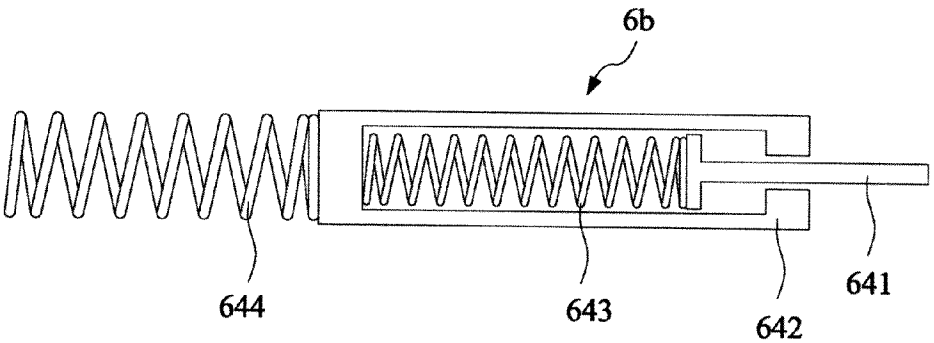
FIG. 6 is a longitudinal sectional view of the backward momentum transferring mechanism in accordance with a third embodiment of the present invention.

Referring to FIG. 6, a third preferred embodiment of backward momentum transferring mechanism 6*b* in accordance with the invention is shown. In this embodiment, the backward momentum transferring mechanism 6*b* comprises a receptacle 642, a torsion spring 643 in the receptacle 642, an elongated rod 641 having an enlarged end biased by the spring 643 so that the rod 641 can slide relative to the receptacle 642 back and forth without being detached therefrom, and a helical spring 644 urging against the end of the receptacle 642 distal the rod 641.

Figure 7:
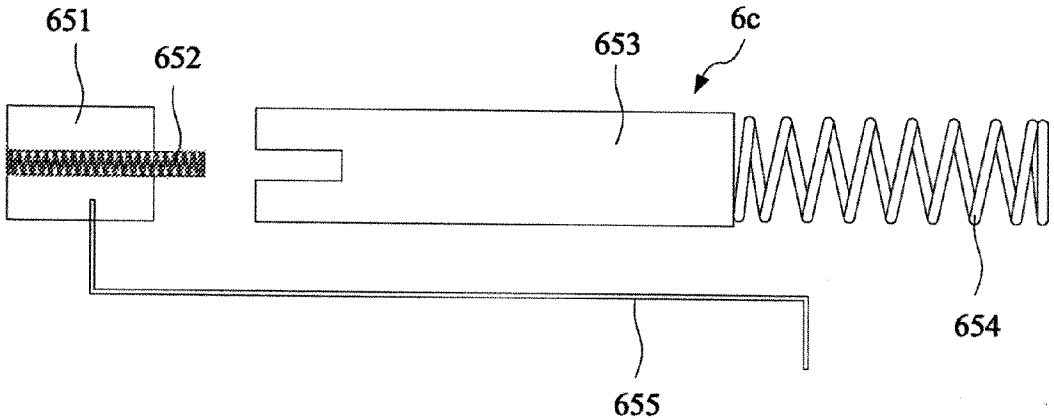
FIG. 7 is a longitudinal sectional view of the backward momentum transferring mechanism in accordance with a fourth embodiment of the present invention.

Referring to FIG. 7, a fourth preferred embodiment of backward momentum transferring mechanism 6*c* in accordance with the invention is shown. In this embodiment, the backward momentum transferring mechanism 6*c* comprises a first weight 651, a rod 652 inserted into the first weight 651, a linking rod 655 connected to the first weight 651, a second weight 653 having a recess at one end facing the rod 652, and a helical spring 654 biased against the other end of the second weight 653.

Figure 8:
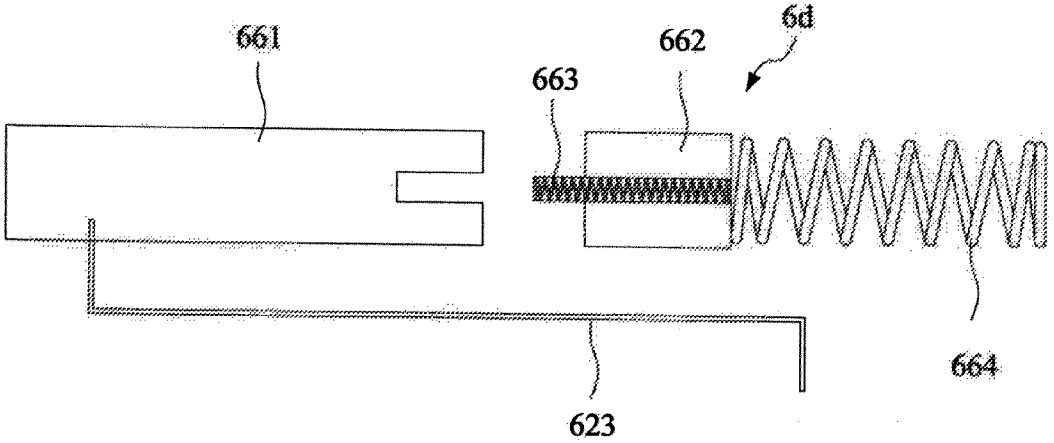
FIG. 8 is a longitudinal sectional view of the backward momentum transferring mechanism in accordance with a fifth embodiment of the present invention.

Referring to FIG. 8, a fifth preferred embodiment of backward momentum transferring mechanism 6*d* in accordance with the invention is shown. In this embodiment, the backward momentum transferring mechanism 6*d* comprises a first weight 661, a second weight 662, a rod 663 inserted into the second weight 662 and facing a recess at one end of the first weight 661, a linking rod 665 connected to the first weight 661, and a helical spring 664 biased against the second weight 662 distal the first weight 661.

Figure 9:
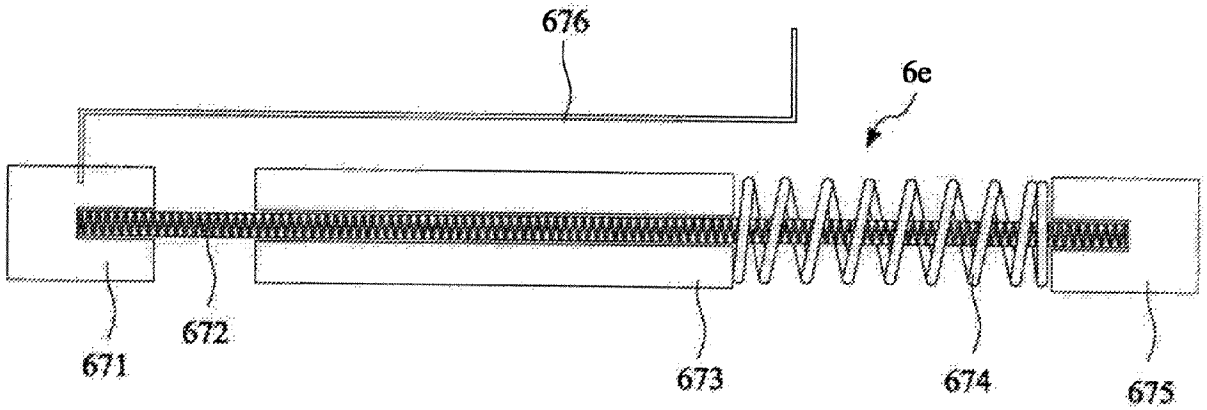
FIG. 9 is a longitudinal sectional view of the backward momentum transferring mechanism in accordance with a sixth embodiment of the present invention.

Referring to FIG. 9, a sixth preferred embodiment of backward momentum transferring mechanism 6*e* in accordance with the invention is shown. In this embodiment, the backward momentum transferring mechanism 6*e* comprises a first weight 671, a second weight 673 spaced from the first weight 671, a seat 675 spaced from the second weight 673 and further spaced from the first weight 671, a rod 672 having one end anchored in the first weight 671, the other end anchored in the seat 675, and the main portion passing the second weight 673, a helical spring 674 biased between the second weight 673 and the seat 675, and a linking rod 676 connected to the first weight 671.

The invention has the following advantages:

The spring of the spring biased rod can absorb momentum transmitted from the weight if the piston and the weight are not in cooperation in reciprocal motion. This can prevent the piston from being damaged by the rod of the spring biased rod.

The spring biased rod and the weight are spaced apart. Thus, it can effectively transfer backward momentum to the gunstock.

A clear metal sound is generated when the spring biased rod collides with the weight in a backward movement (i.e., retreat). Also, a clear metal sound is generated when the spring biased rod collides with the housing in a forward movement (i.e., advancement).

No baffle plates are provided in the gunstock. The invention is more durable, the number of components is decreased, and the construction is simpler. Moreover, an increased moving distance is achieved by the weight so as to generate a recoil shock.

The spring biased rod is not a unitary member and is mounted with a spring. Thus, an improved buffering effect is made possible.

The spring biased rod of the invention can prevent the speed reduction gear and the piston from being damaged when the weight moves backward in response to the discharge of the toy gun.

While the invention has been described in terms of preferred embodiments, those skilled in the art will recognize that the invention can be practiced with modifications within the spirit and scope of the appended claims.

What is claimed is:

1. A toy gun comprising:

a housing;

a bullet loading unit in a forward end of the housing;

a piston in a fixed cylinder of the housing;

a gunstock coupled to the housing; and a backward momentum transferring mechanism partially disposed in the gunstock and including an intermediate weight, a sliding rod disposed rearward of the piston, and a rear recoil spring having a front end urging against a rear end of the intermediate weight and a rear end urging against a stop wall formed in the gunstock;

wherein the sliding rod is disposed in an initial position prior to operation of a trigger of the toy gun, the first position being between the piston and the intermediate weight and spaced apart from the intermediate weight, the space between the sliding rod and the intermediate weight being devoid of other elements, a front end of the sliding rod engages with the piston, and a rear end of the sliding rod extends into the gunstock;

wherein the sliding rod is driven with the piston from the initial position into contact with the intermediate weight to generate an audible metallic sound, and displaces the intermediate weight against a bias force of the rear recoil spring responsive to operation of the trigger of the toy gun to compress the rear recoil spring and thereafter transfer a backward momentum to the gunstock.

2. The toy gun as claimed in claim 1, wherein the sliding rod is a spring biased rod.

3. The toy gun as claimed in claim 2, wherein the spring biased rod comprises a receptacle, a helical spring disposed in the receptacle, and an elongated rod partially disposed in the receptacle and having an end engaged with the helical spring, such that the elongated rod is adapted to slide relative to the receptacle.

4. The toy gun as claimed in claim 3, wherein the receptacle is formed with a hollow space and the helical spring is disposed in the hollow space of the receptacle.

* * * * *